United States Patent [19]

Huon de Kermadec et al.

[11] Patent Number: 4,762,070

[45] Date of Patent: Aug. 9, 1988

[54] TRANSPORT INSTALLATION COMPRISING A GUIDE TRACK AND CIRCULATING CABLE DRIVEN CARS

[75] Inventors: Jean Huon de Kermadec, Le Chesnay; Guy M. C. M. Thomas, Bagneres de Bigorre, both of France

[73] Assignee: SOULE, Bagneres De Bigorre, France

[21] Appl. No.: 941,142

[22] Filed: Dec. 12, 1986

[30] Foreign Application Priority Data

Dec. 18, 1985 [FR] France ..... 85 18789

[51] Int. Cl.[4] ..... B61B 12/12

[52] U.S. Cl. ..... 104/173.1; 104/231; 104/211

[58] Field of Search ..... 104/173.1, 202, 205, 104/206, 208, 211, 214, 216, 215, 224, 229, 231, 232, 233; 440/34

[56] References Cited

U.S. PATENT DOCUMENTS 351,901 11/1886 Dougherty ..... 104/231
4,512,259 4/1985 Huon de Kermadec ..... 104/208

FOREIGN PATENT DOCUMENTS 28155 8/1884 Fed. Rep. of Germany .
40091 6/1887 Fed. Rep. of Germany .
46173 2/1889 Fed. Rep. of Germany .
242598 7/1926 United Kingdom .

*Primary Examiner*—Sherman D. Basinger
*Assistant Examiner*—Edwin L. Swinehart
*Attorney, Agent, or Firm*—Perry Carvellas

[57] ABSTRACT

A transport installation comprises a guide track and at least one car which moves on the track. A circulating cable is provided near the track and a gripping device on the car grips the cable. Lateral retaining members are fixed to the car and accommodate the cable at least when it is gripped by the gripping devices. There are at least two such lateral retaining members disposed on respective sides of the gripping device. They are adapted to hold the cable betweem them at least substantially in a vertical plane.

14 Claims, 4 Drawing Sheets

TRANSPORT INSTALLATION COMPRISING A GUIDE TRACK AND CIRCULATING CABLE DRIVEN CARS

BACKGROUND OF THE INVENTION

1. Field of the Invention

The invention relates to a transport installation comprising a guide track and one or more cars adapted to move on the same track, a railroad type track, for example, being driven by a circulating cable near the track. The invention relates more specifically to improvements to mechanical systems provided under the car, both to facilitate insertion of the cable into the gripping means at the time the corresponding car is on the point of leaving a departure station and to ensure subsequently improved adhesion of the gripping means to the cable, especially when the car enters a grade and/or a curve.

2. Description of the Prior Art

There is a known transport installation using a car or cars able to accommodate a limited number of passengers (in the order of ten persons, for example) and designed to convey these passengers over average distances in the order of a few hundred meters. An installation of this kind described in U.S. Pat. No. 4,512,259. In this installation a cable is driven continously in a closed loop along the track and the car or cars are temporarily attached to it by appropriate gripping means to be driven from one point to another. These gripping means preferably consist in at least two braked wheels linked to an articulated mechanical system to come into contact with each other through their respective rolling surfaces, gripping the aforementioned cable between them. When the gripping means are coupled to the cable the braked wheels are driven by the cable, opposing a certain degree of resistance to this so that the speed of the car increases gradually until it stabilizes at the same value as the speed of the cable. With an arrangement of this kind significant deflection of the cable to either side of the gripping means may be observed in curves, which is likely to lead to fatigue failure of the cable due to bending stresses.

In one aspect, the invention provides a solution to this problem.

SUMMARY OF THE INVENTION

The present invention consists in a transport installation comprising a guide track, at least one car adapted to move on said track, a circulating cable near said track, gripping means on said at least one car adapted to grip said cable and lateral retaining members fixed to said at least one car and adapted to accommodate said cable at least when it is gripped by said gripping means, there being at least two lateral retaining members disposed on respective sides of said gripping means and adapted to hold the cable between them at least substantially in a vertical plane.

Also, and in accordance with another advantageous characteristic of the invention, each retaining member has its part farthest away from the gripping means outwardly flared. In this way the cable gripped by the gripping means may bear against the inside walls of this flared portion in curves, which limits its maximum curvature to a given value. Also, the curvature of the cable in the curves has no effect on the gripping means since the portion of the cable to each side of the gripping means remains straight virtually all the time.

In a preferred embodiment, each lateral retaining member comprises substantially vertical flanges extending lengthwise of the cable and having bottom longitudinal edges defining an opening into which the cable may be inserted. In this case, the flanges have end parts farthest away from the gripping means curved to diverge from each other, which defines the previously mentioned outwardly flared part.

When the cable is inserted into the gripping means, on leaving a station, for example, it is necessary for the cable, which circulates continuously, to be guided so that it is inserted into a temporarily available space between the gripping members, before these are again pressed against each other. This operation entails raising the cable into the aforementioned space, this being associated with vertical relative movement between the car and the cable, for example by providing a slight downward grade on the guide track.

Another advantageous feature of the invention consists in using the curvature of the flanges to guide insertion of the cable between the gripping means.

Another advantageous feature of the invention consists in keeping the cable substantially straight to each side of the gripping means when the car passes over a hump by providing bottom abutment members articulated so as to move transversely relative to the cable (during insertion and release of the cable) and to be positioned beneath the cable when gripped by the gripping means, such abutment members being provided to each side of the gripping means and preferably articulated to them.

The invention will be better understood and other advantages of the invention will emerge more clearly from the following description of a currently preferred embodiment of a system in accordance with the invention given by way of example only and with reference to the appended drawings.

DESCRIPTION OF THE PREFERRED EMBODIMENT

Figure 1:
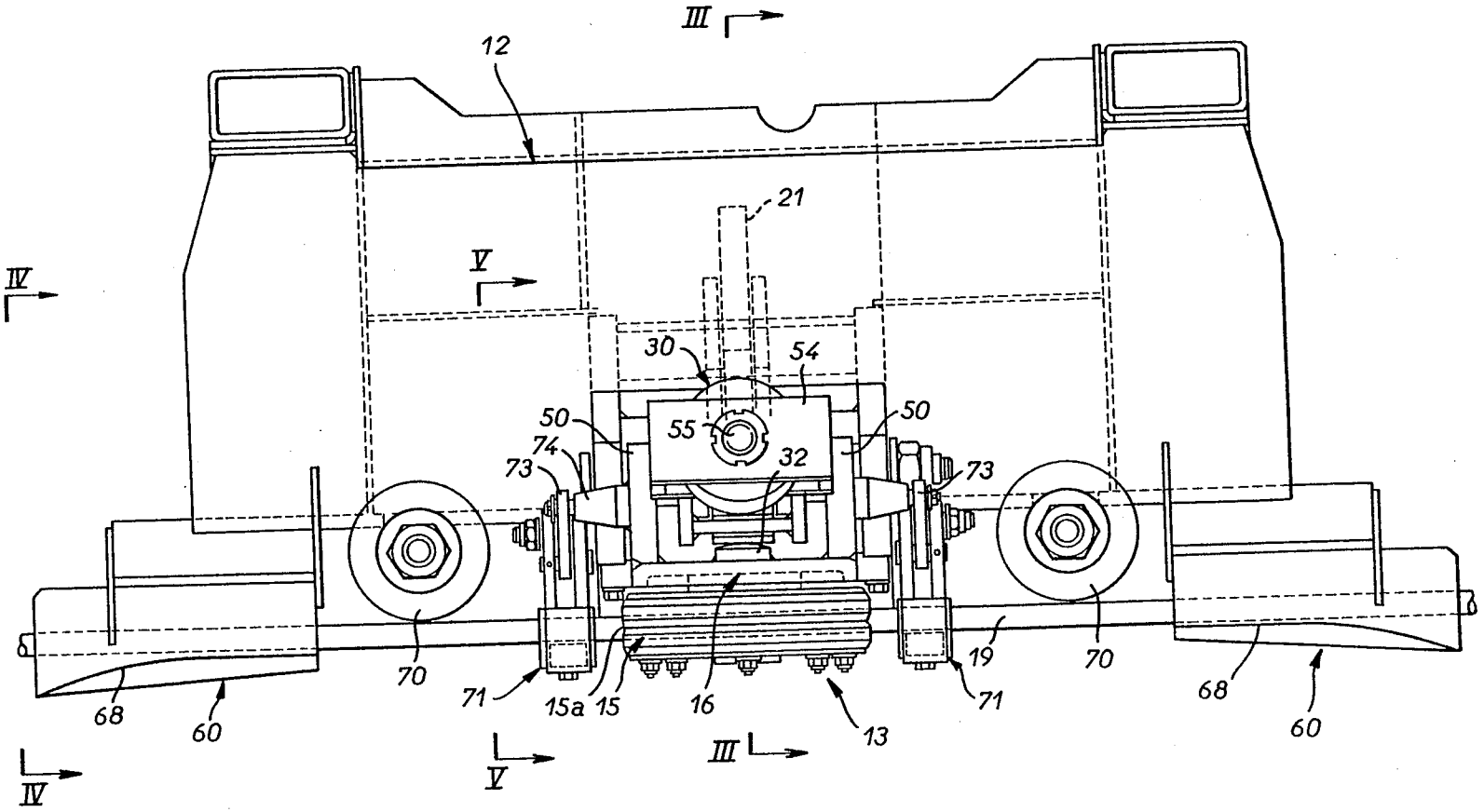
FIG. 1 is a schematic view in elevation of a lower part of the chassis of a car, showing in particular the gripping means and the lateral retaining members cooperating with a drive cable.

Referring to the drawings, there is shown the lower part of a chassis 12 of a car adapted to move along a track (not shown), the chassis carrying gripping means 13 including two gripping members movable relative to each other, specifically in this instance a gripping member 14 mounted on the chassis 12 and a gripping member 15 mounted on a first pivoting support 16 in turn articulated on a first shaft 17 carried by the chassis 12. Rotation of the first pivoting support 16 in the clockwise direction in FIG. 3 results in closing of the gripping means, that is to say movement of the gripping member 15 towards the gripping member 14, so gripping the traction cable 19 by which the car is driven along the track. In the example being described, both gripping members 14 and 15 are braked wheels, that is to say wheels comprising internally friction facings urged at all times against a mobile surface (this conventional arrangement not being shown in the drawings) so that the wheel can be driven in rotation to which it opposes a braking force. Consequently, the wheel 14 can turn about its axis relative to the chassis 12 while the wheel 15 can turn about its axis relative to the pivoting support 16. The gripping means and in particular the pivoting support 16 are articulated so as to apply the rolling surface of the wheel 15 against the rolling surface of the wheel 14, the cable being accommodated between them, to be more precise, between two circular grooves 14*a*, 15*a* defined on the respective rolling surfaces of the wheels. The wheels are surfaced with rubber, polyurethane or the like.

The gripping means 13 are closed by a force F generated within the car and applied to a control link 21. As previously mentioned, this force F is developed by a system forming means for weighing a cabin suspended above the chassis 12, as described in the aforementioned U.S. patent, for example. Thus the traction force F exerted on the link 21 is representative of the weight of the cabin, which means that it varies according to the number of passengers.

Figure 3:
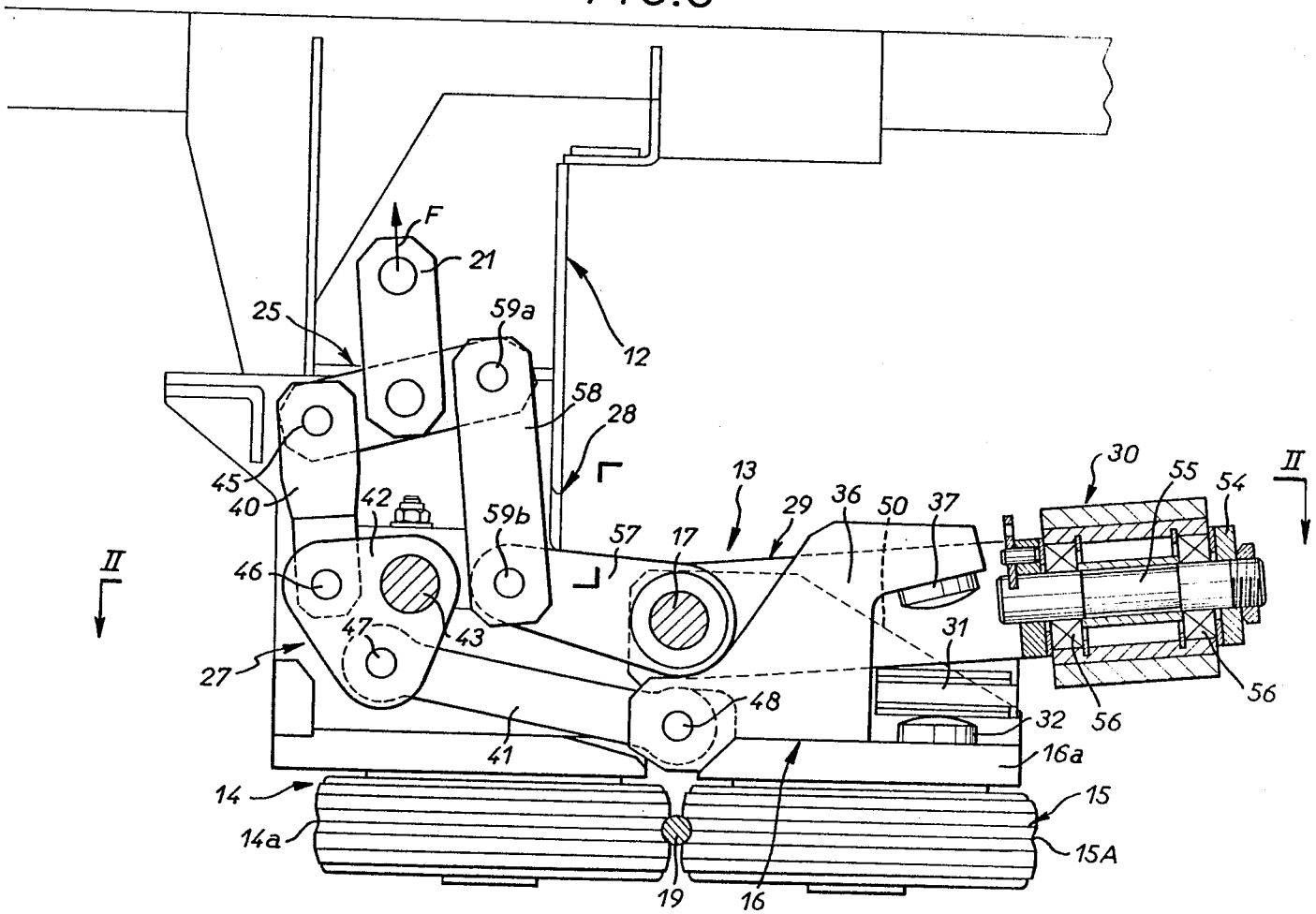
FIG. 3 is a view in partial cross-section on the line III—III in FIG. 1.

The gripping means 13 comprise a force distributor mechanism in the form of a rocking lever 25 suspended from the link 21 and articulated to two transmission branches extending between respective ends of the rocking lever and the gripping member 15. Thus the rocking lever transmits part of the force F to each branch. A first branch 27 is articulated directly to the first pivoting support 16 while a second branch 28 is articulated to a second pivoting support 29 comprising engagement means 30 and an abutment member 31 adapted to come into contact with a stud forming a first bearing surface 32 on the first pivoting support 16. The second pivoting support 29 is mounted to pivot on the first shaft 17. The arrangement is therefore such that, when acted on by the part of the force F that is applied to it by the second branch 28, the abutment member 31 comes into contact with the bearing surface 32 and therefore urges the first pivoting support in the same direction as the first branch 27. This is the situation as shown in FIG. 3 in particular. In this case, all of the force F is used to grip the cable 19. This is the normal state of the gripping means when the car is moving between two stations. In this situation the engagement means 30 does not co-operate with any structural member fixed relative to the track.

The first pivoting support 16 comprises an upper extension 36 carrying another stud forming a second bearing surface 37 spaced from the surface 32 and the abutment member 31 fastened to the second pivoting support 29 is mounted so as to be able to move between the bearing surfaces 32 and 37. It will thus be understood that if the engagement means 30 are sufficiently raised the abutment member 31 can come into contact with the bearing surface 37 and hold the gripping means open. This is the situation illustrated in FIG. 5.

Thus when the car arrives at a station where it is necessary to separate the car from the cable so that the car may be effectively braked to a halt, the engagement means 30 encounters a ramp member (not shown) fixed relative to the track and which raises the second pivoting support 29 sufficiently for the abutment member 31 to be able in its turn to co-operate with the bearing surface 37 on the first pivoting support in order to tilt it back and so release the cable 19.

On leaving a station, on the other hand, the engagement means 30 co-operate with another ramp member which extends between at least two predetermined levels (becoming gradually lower in the direction of movement). As long as the ramp is at a certain level the gripping means remain open and the cable 19 is guided into a position between the gripping members 14 and 15. The ramp then drops down to a second level in which the abutment member 31 is released from the bearing surface 37 but is not yet in contact with the bearing surface 32. The cable 19 is therefore gripped between the gripping members 14 and 15 but the gripping force communicated to the pivoting support 16 represents only part of the force F, namely that transmitted by the first branch 27 of the gripping means. The ramp member then gets lower along the path of the car until the abutment member 31 comes into contact with the bearing surface 32. From this moment all of the force F communicated to the gripping means 13 contributes to gripping of the cable 19 between the gripping members 14 and 15. This is the situation illustrated in FIG. 3.

Figure 2:
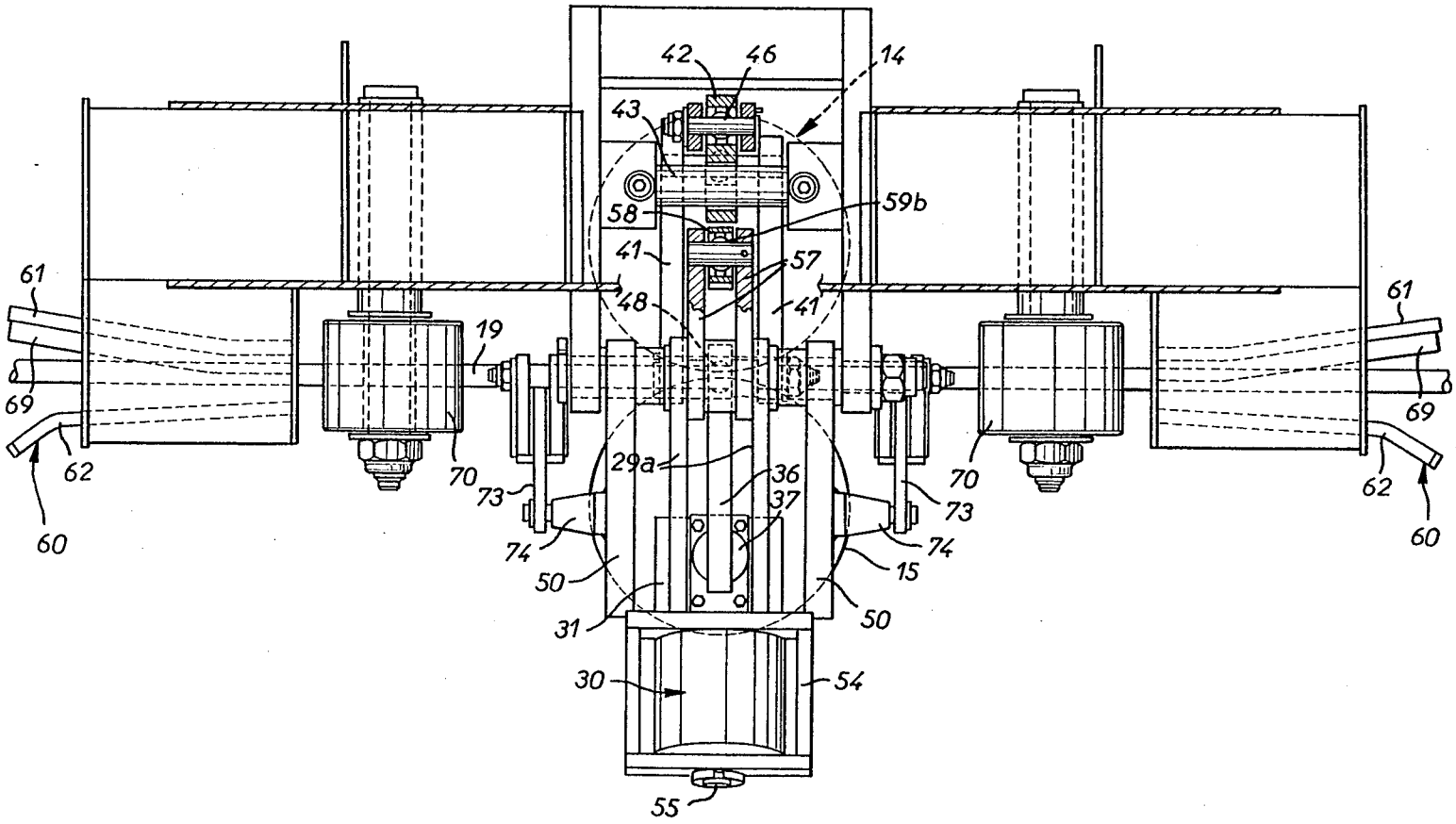
FIG. 2 is a plan view in partial cross-section on the line II—II in FIG. 3 of the same part of the installation.

Returning now to FIGS. 1 through 3 in particular, the principal component parts of the gripping means 13 will be described in more detail. In particular, the first branch 27 comprises two members 40 and 41 forming links and a connecting member 42 mounted to pivot on a second shaft 43 carried by the chassis 12. The shaft 43 is parallel to the shaft 17. The element 40 is articulated between one end of a rocking lever 25, by means of a pivot pin 45, and its other end is formed as a yoke in order to be articulated by a pivot pin 46 to the connecting member 42. The link member 41 is of generally rectangular shape each of the two shorter sides of which carries a respective pivot pin 47, 48 at the center. The pivot pin 47 articulates the member 41 to the connecting member 42 while the pivot pin 48 articulates the member 41 to the first pivoting support 16. This comprises two flanges 50 by means of which it is fixed to the shaft 17. The flanges are linked by a lower base member 16*a* carrying the clamping member 15 and the first bearing surface 32.

The second pivoting support 29 essentially comprises two parallel arms 29*a* mounted at one end on the shaft 17 and carrying the abutment member 31 as well as a frame 54 through which extends a shaft 55 carrying the engagement means 30. This is in the form of a roller mounted to rotate on the shaft 55 through the intermediary of ball bearings 56. On the other side of the shaft 17 the second pivoting support 29 is extended by a lever 57 itself formed by two parallel arms constituting a yoke. The aforementioned second branch 28 is formed by a link member 58 articulated by a pivot pin 59*a* to the other end of the rocking lever 25 and by a pivot pin 59*b* to the lever 57.

Figure 4:
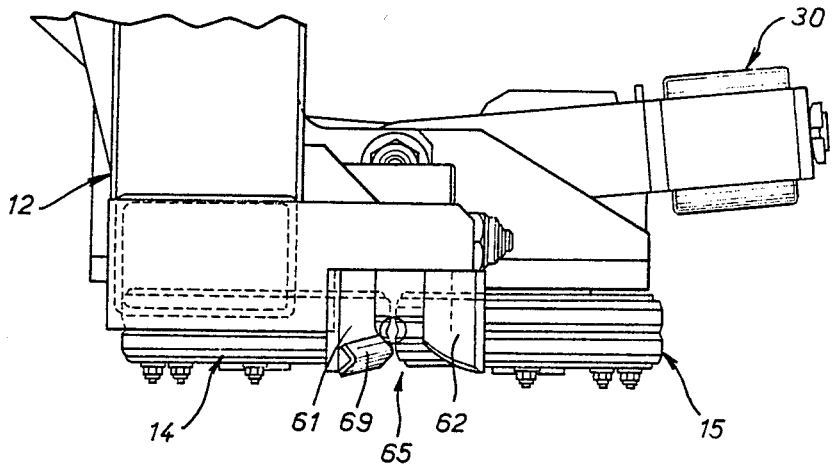
FIG. 4 is a view in cross-section on the line IV—IV in FIG. 1, an articulated bottom abutment member having been omitted to avoid overcomplicating the diagram.

In accordance with an important feature of the invention lateral retaining members 60 fixed to the chassis 12 are designed to accommodate the cable 19 when it is gripped by the gripping means 13. Two lateral retaining members 60 are provided on respective sides of the gripping means 13 to hold the portion of cable 19 situated between them at least substantially in a vertical plane. This avoids any fatigue stressing of the cable in curves of the guide track, such as could result from excessive curvature of the cable and the braked wheels. In the example shown, each lateral retaining member 60 is formed by two substantially vertical flanges 61, 62 extending lengthwise of the cable 19 and defining through their bottom longitudinal edges an opening 65 for the cable 19 to be inserted into and released from. The flange 61 of each retaining member 60 is that on the same side of the cable 19 as the fixed gripping member 14 whereas the flange 62 is that on the same side of the cable as the mobile gripping member 15 (see FIG. 4). The flanges are shaped to guide the cable away from the fixed gripping member 14 when the cable 19 moves upwards relative to the car, prior to actuation of the gripping means 13. In other words, when the gripping means are open and the guide track (not shown) drops slightly relative to the means for circulating the cable 19, the shapes and the structural features of the flanges 61 and 62 facilitate insertion of the cable 19 between the gripping members 14 and 15, in particular preventing the cable coming into contact with the lower part of the fixed gripping member 14, which could prevent it assuming the correct position. To this end the flange 62 which is on the same side as the mobile gripping member 15 has a curved lower edge 68 diverging from the gripping means. The flange 61 on the same side as the fixed gripping member 14 features a rib 69 along the inside of its lower (straight) edge and the lower surface of this rib is inclined to guide the cable away from the fixed gripping member 14 when the cable moves upward relative to the car (prior to actuation of the gripping means 13) due to the cabin "dipping" towards the cable. The end parts of these flanges farthest away from the gripping means 13 are curved to diverge from each other. The outwardly flared shape due to the curvature of the end parts of the flanges provides better control over flexing of the cable in line with the corresponding retaining member and facilitates insertion of the cable between the flanges during such "dipping".

At the end of such "dipping" of the car the position of the cable relative to the gripping means is stabilized vertically by positioning rollers 70 mounted on the car to either side of the gripping means 13. When the cable 19 is in contact with these rollers it is at the correct level to be gripped between the gripping members 14 and 15 and positioned between the grooves 14*a* and 15*a* of the latter.

With the arrangement which has just been described, the lateral retaining member 60 that first encounters the cable 19 when the car moves downward relative to the cable is adapted to guide it laterally, if necessary, towards an appropriate position relative to the gripping means, by virtue of its outwardly flared end and the lateral ramp surfaces formed on the one hand by the lower edge of the flange 62 and on the other hand by the rib on the flange 61, the result of which is to place the cable in a position facing the rolling surface of the gripping member 14 whilst preventing it coming into contact with the lower part thereof. This guided movement continues until the cable 19 comes into contact with the rollers 70 which ensure that it is in the correct vertical position relative to the gripping means 13.

Figure 5:
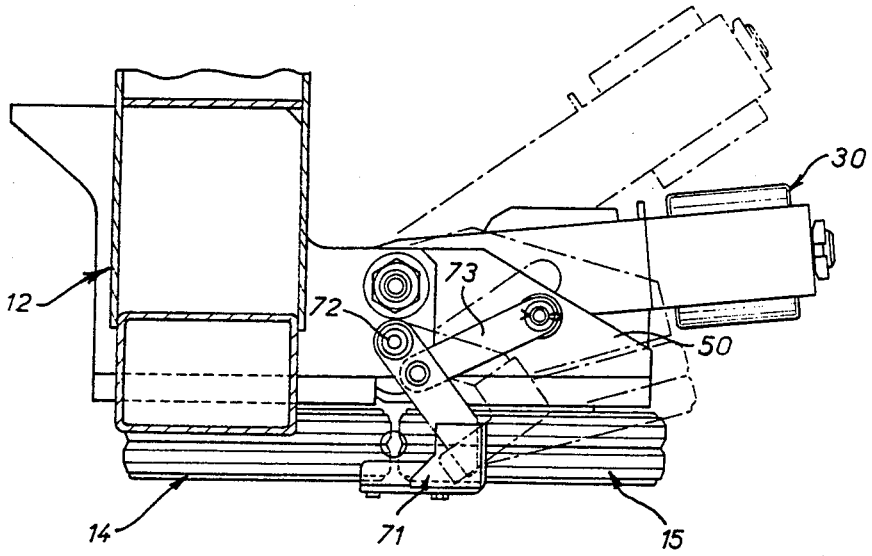
FIG. 5 is a view in cross-section on the line V—V in FIG. 1, showing in particular the structure of the articulated bottom abutment member.

With particular reference to FIG. 5, it is seen that the installation further comprises lower abutment members 71 which are articulated to move transversely (by pivoting) relative to the cable 19 and to be situated beneath the cable when it is gripped by the gripping means 13. Two abutment members 71 are provided on respective sides of the gripping means to hold the portion of cable situated between them substantially in a horizontal plane. These abutment members must prevent the portion of the cable gripped by the gripping means becoming curved when the car starts up a hump, which makes it possible to prevent any change in the gripping conditions, due to curvature of the cable in particular, on passing over any such obstacle. The abutment members 71 are in the form of hooks mounted to pivot about a shaft 72 fixed to the chassis and articulated by a link 73 to a movable part of the gripping means, in this instance projections 74 fastened to the flanges 50 of the first pivoting support 16. This arrangement is shown in FIG. 5 in particular, where the position of the abutment member 71 is shown in full line where it underlies the cable and in chain-dotted line when it is distanced from the opening in the gripping means to prevent it impeding release of the cable 19.

There is claimed:

1. Transport installation comprising at least one car, a circulating cable disposed near said car, gripping means on said at least one car adapted to grip said cable and lateral retaining members fixed to said at least one car and adapted to accommodate said cable at least when it is gripped by said gripping means, there being at least two lateral retaining members disposed on respective sides of said gripping means, wherein each lateral retaining member comprises two substantially vertical flanges extending lengthwise of said cable and having bottom longitudinal edges defining an opening into which said cable may be inserted and adapted to hold said cable between them at least substantially in a vertical plane.

2. Transport installation according to claim 1, wherein each retaining member has its part farthest away from said gripping means outwardly flared.

3. Transport installation according to claim 1, wherein said gripping means comprise a fixed gripping member and a movable gripping member adapted to be pressed against said fixed gripping member with said cable gripped between them and said flanges are shaped to guide said cable away from said fixed gripping member when said cable moves upwards relative to said at least one car prior to actuation of said gripping means.

4. Transport installation according to claim 1, wherein said flanges have end parts farthest away from said gripping means curved to diverge from each other.

5. Transport installation according to claim 1, wherein said at least one car comprises two rollers disposed above said cable and on respective sides of said gripping means for positioning said cable vertically and maintaining said cable in a stable raised position relative to said gripping means at the time said gripping means are actuated.

6. Transport installation according to claim 1, further comprising bottom abutment members articulated to move transversely relative to said cable and to be positioned beneath said cable when gripped by said gripping means, there being at least two such bottom abutment members disposed on respective sides of said gripping means to hold the portion of said cable situated between them substantially in a horizontal plane.

7. Transport installation according to claim 6, wherein said abutment members are hooks attached to a mobile part of said gripping means so as to move away from said cable when said gripping means opens.

8. Transport installation comprising at least one car, a circulating cable disposed near said car, gripping means on said at least one car adapted to grip said cable and lateral retaining members fixed to said at least one car and adapted to accommodate said cable at least when it is gripped by said gripping means, there being at least two lateral retaining members disposed on respective sides of said gripping means and adapted to hold said cable between them at least substantially in a vertical plane, wherein each lateral retaining member comprises two substantially vertical flanges extending lengthwise of said cable and having bottom longitudinal edges defining an opening into which said cable may be inserted, and said gripping means comprise a fixed gripping member and a movable gripping member adapted to be pressed against said fixed gripping member with said cable gripped between them and said flanges are shaped to guide said cable away from said fixed gripping member when said cable moves upwards relative to said at least one car prior to actuation of said gripping means.

9. Transport installation according to claim 8, wherein said flange on the same side as said movable gripping member has a curved lower edge diverging from said gripping means.

10. Transport installation according to claim 8, wherein said flange on the same side as said fixed gripping member has a rib along the inside of its bottom edge and said rib has an inclined lower surface adapted to guide said cable away from said fixed gripping member when said cable moves upwards relative to said at least one car prior to actuation of said gripping means.

11. Transport installation according to claim 8, wherein said flanges have end parts farthest away from said gripping means curved to diverge from each other.

12. Transport installation according to claim 8, wherein said at least one car comprises two rollers disposed above said cable and on respective sides of said gripping means for positioning said cable vertically and maintaining said cable in a stable raised position relative to said gripping means at the time said gripping means are actuated.

13. Transport installation according to claim 8, further comprising bottom abutment members articulated to move transversely relative to said cable and to be positioned beneath said cable when gripped by said gripping means, there being at least two such bottom abutment members disposed on respective sides of said gripping means to hold the portion of said cable situated between them substantially in a horizontal plane.

14. Transport installation according to claim 13, wherein said abutment members are hooks attached to a mobile part of said gripping means so as to move away from said cable when said gripping means open.

* * * * *